US008564383B2

(12) United States Patent
Shimura et al.

(10) Patent No.: US 8,564,383 B2
(45) Date of Patent: Oct. 22, 2013

(54) SIGNAL CONVERTER AND HIGH-FREQUENCY CIRCUIT MODULE

(75) Inventors: Toshihiro Shimura, Kawasaki (JP); Yoji Ohashi, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 360 days.

(21) Appl. No.: 12/961,609

(22) Filed: Dec. 7, 2010

(65) Prior Publication Data

US 2011/0140801 A1 Jun. 16, 2011

(30) Foreign Application Priority Data

Dec. 14, 2009 (JP) ..... 2009-282796

(51) Int. Cl.
*H01P 5/107* (2006.01)

(52) U.S. Cl.
USPC ..... 333/26; 333/247

(58) Field of Classification Search
USPC ..... 333/26, 25, 34, 246, 247, 254, 260
See application file for complete search history.

(56) References Cited

U.S. PATENT DOCUMENTS

| | | | |
|---|---|---|---|
| 7,142,074 | B2 | 11/2006 | Kim et al. |
| 7,170,373 | B2 | 1/2007 | Ito et al. |
| 7,439,822 | B2 | 10/2008 | Shimura et al. |
| 2002/0097108 | A1 | 7/2002 | Jain |

FOREIGN PATENT DOCUMENTS

| | | | |
|---|---|---|---|
| EP | 0984504 | A2 | 3/2000 |
| JP | 2003-229703 | | 8/2003 |
| JP | 2006-340317 | A | 12/2006 |

OTHER PUBLICATIONS

"Extended European Search Report", mailed by EPO and corresponding to European application No. 10193271.3 on Mar. 22, 2011.
Deslandes, Dominic et al., "Integrated Microstrip and Rectangular Waveguide in Planar Form", IEEE Microwave and Wireless Components Letters, vol. 11, No. 2, Feb. 1, 2001.
Suntives, Asanee et al., "Design and Characterization of the EBG Waveguide-Based Interconnects", IEEE Transactions on Advanced Packaging, vol. 30, No. 2, May 1, 2007, pp. 163-170.
Chen, et al, "Low-Loss Ultra-Wideband Transition between Conductor-Backed Coplanar Waveguide and Substrated Integrated Waveguide", 2009 IEEE MTT-S International Microwave Symposium Digest, Jul. 2009, pp. 349-352.

*Primary Examiner* — Stephen Jones
(74) *Attorney, Agent, or Firm* — Fujitsu Patent Center

(57) ABSTRACT

A signal converter includes: a dielectric substrate; a first conductor layer disposed on one of opposite sides of the dielectric substrate, while including an input section receiving high-frequency signals inputted thereto; a second conductor layer disposed on the other of the opposite sides of the dielectric substrate; and plural first conducting sections penetrating the dielectric substrate for electrically connecting the first and second conductor layers, while forming a waveguide in the inside of the dielectric substrate with the first and second conductor layers. The first conductor layer is disposed on the dielectric substrate without occupying a separator section disposed on the dielectric substrate. The separator section includes first and second sections extend from the input section towards the waveguide. The first and second sections are separated away from each other for gradually increasing their interval in proportion to a distance away from the input section towards the waveguide.

10 Claims, 13 Drawing Sheets

SIGNAL CONVERTER AND HIGH-FREQUENCY CIRCUIT MODULE

CROSS-REFERENCE TO RELATED APPLICATIONS

This application is based upon and claims the benefit of priority of the prior Japanese Patent Application No. 2009-282796, filed on Dec. 14, 2009, the entire contents of which are incorporated herein by reference.

FIELD

The present invention relates to a signal converter and a high-frequency circuit module for converting a propagation mode of high-frequency signals at a microwave band and a millimeter-wave band.

BACKGROUND

When short-wavelength (e.g., millimeter-wave) high-frequency signals are transmitted from an antenna, transmission loss is increased in directly providing high-frequency signals to the antenna from a circuit chip. In response, Japanese Laid-open Patent Publication No. 2006-340317 describes a technology configured to convert high-frequency signals from a normal mode to a waveguide-tube propagation mode and subsequently provide the post mode-conversion high-frequency signals to the antenna in order to reduce the transmission loss.

A high-frequency circuit module of the well-known type will be hereinafter explained with reference to FIG. 12. FIG. 12 is a schematic cross-sectional view of the high-frequency circuit module of the well-known type. As illustrated in FIG. 12, the high-frequency circuit module 1 of the well-known type includes a hollow waveguide tube 2, a waveguide substrate 3, and a semiconductor circuit chip 4. The hollow waveguide tube 2 is mounted on the waveguide substrate 3. The waveguide substrate 3 includes a waveguide 3A for transmitting high-frequency signals. The waveguide 3A is coupled to the hollow waveguide tube 2. The semiconductor circuit chip 4 is mounted on the waveguide substrate 3.

The waveguide substrate 3 includes a dielectric plate 31, conductor layers 32*a*, 32*b*, and a plurality of conducting posts 33. The conductor layers 32*a*, 32*b* are disposed on the both sides of the dielectric plate 31. The conducting posts 33 are aligned in two rows while each low includes a plural number of conducting posts 33. The conducting posts 33 are configured to establish electrical conduction between the conductor layer 32*a* disposed on one side of the dielectric plate 31 and the conductor layer 32*b* disposed on the other side of the dielectric plate 31. The waveguide 3A is a dielectric part enclosed by the conductor layers 32*a*, 32*b* and the conductive posts 33 aligned in two rows.

The waveguide substrate 3 is supported by a support member 6.

An island-shaped metal pad 37 is disposed on the surface of the waveguide substrate 3 that the semiconductor circuit chip 4 is mounted. Specifically, the metal pad 37 is surrounded by the conductor layer 32*a* through a gap 37*a*. The metal pad 37 is connected to a signal line of the semiconductor circuit chip 4 in an upstream position within the waveguide 3A.

Further, a metal-pad conducting post 33*d* is disposed in the waveguide substrate 3. FIG. 13 is a cross-sectional view of the high-frequency circuit module sectioned along a line A-A' in FIG. 12. As illustrated in FIG. 13, an underfiller 43 is filled in the clearance between the semiconductor circuit chip 4 and the waveguide substrate 3. Accordingly, the semiconductor circuit chip 4 is mounted on the waveguide substrate 3 by flip-chip bonding. Further, a signal line 41 of the semiconductor circuit chip 4 is connected to the metal pad 37 through a metal bump 41*b*. Meanwhile, the metal pad 37 is connected to the conductor layer 32*b* through the metal-pad conducting post 33*d*. High-frequency signals from the signal line 41 of the semiconductor circuit chip 4 are converted from the normal mode to the propagation mode for propagating the waveguide 3A (hereinafter referred to as the waveguide-3A propagation mode) through the metal-pad conducting post 33*d*.

In the high-frequency circuit module 1 of the well-known type, the gap 37*a* and the metal-pad conducting post 33 are formed in different processing steps. Therefore, positional displacement may occur between the gap 37*a* and the metal-pad conducting post 33*d* in the manufacturing processing of the high-frequency circuit module 1. The positional displacement produces a drawback of reduction in efficiency of converting high-frequency signals, transmitted from the signal line 41 of the semiconductor circuit chip 4, from the normal mode to the waveguide-3A propagation mode

SUMMARY

According to an aspect of the present invention, a signal converter includes a dielectric substrate, a first conductor layer, a second conductor layer and a plurality of first conducting sections. The first conductor layer is disposed on one of opposite sides of the dielectric substrate. The first conductor layer includes an input section configured to receive high-frequency signals inputted thereto. The second conductor layer is disposed on the other of the opposite sides of the dielectric substrate. The conducting sections penetrate the dielectric substrate for electrically connecting the first conductor layer and the second conductor layer. The conducting sections form a waveguide in the inside of the dielectric substrate together with the first conductor layer and the second conductor layer. Further, the first conductor layer is disposed on the dielectric substrate without occupying a separator section disposed on the dielectric substrate. The separator section includes first and second sections extended from the input section to the waveguide. The first and second sections are separated away from each other for increasing an interval between the first and second sections in proportion to a distance away from the input section towards the waveguide.

According to a second aspect of the present invention, a high-frequency circuit module includes the aforementioned signal converter and a circuit chip.

According to the signal converter and the high-frequency circuit module of the aforementioned aspects of the present invention, it is possible to efficiently convert high-frequency signals from a normal mode to a waveguide propagation mode.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

BRIEF DESCRIPTION OF DRAWINGS

Referring now to the attached drawings which form a part of this original disclosure.

DESCRIPTION OF EMBODIMENTS

An exemplary signal converter and an exemplary high-frequency circuit module will be hereinafter explained based on exemplary embodiments of the present invention.

<First Exemplary Embodiment>

In a first exemplary embodiment, high-frequency signals from a semiconductor circuit chip are configured to be converted into high-frequency signals transmittable through a waveguide in the inside of a dielectric substrate. The signal converter and the high-frequency circuit module will be explained.

Figure 1:
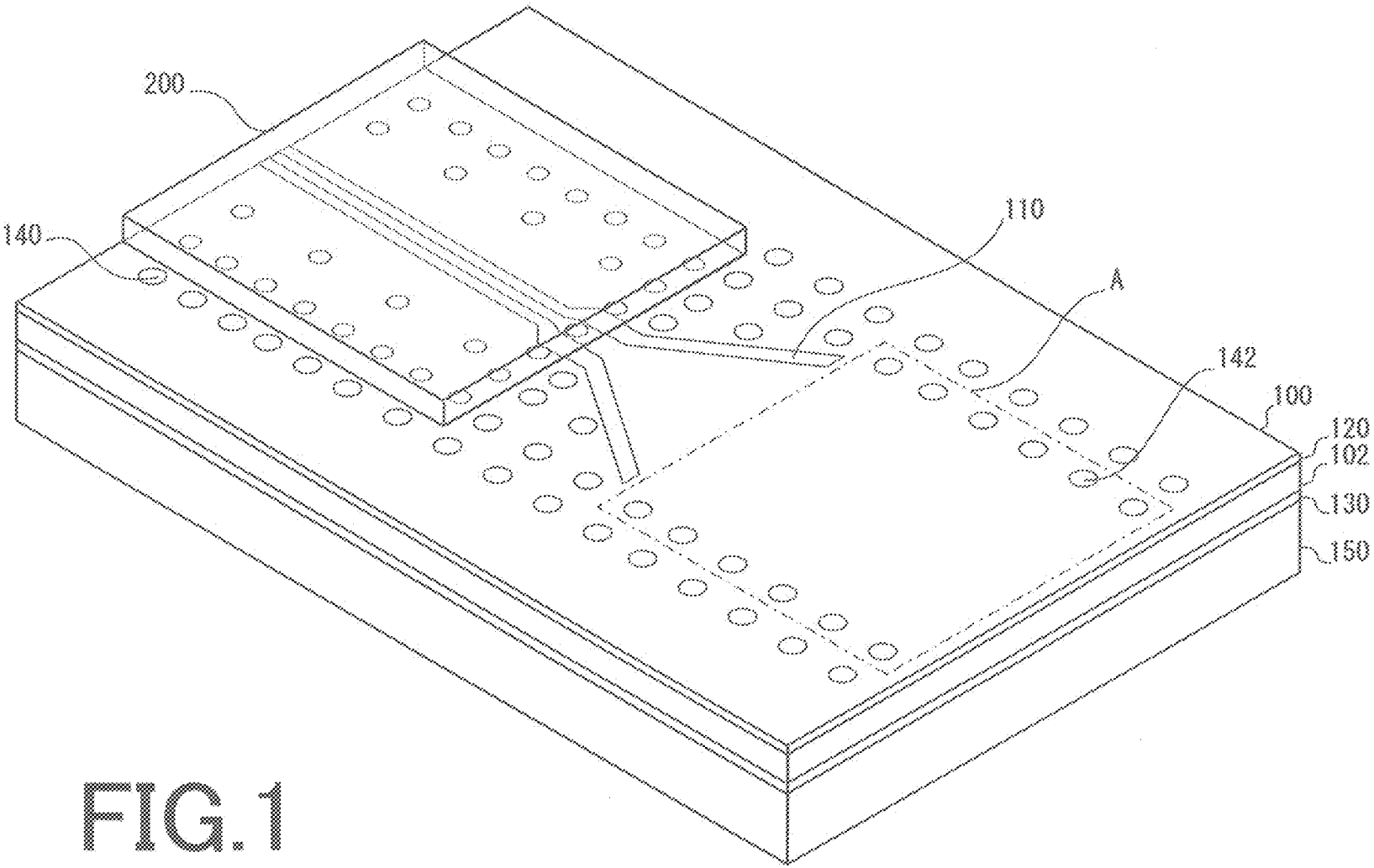
FIG. 1 is an oblique view of an overall configuration of a high-frequency circuit module according to an exemplary embodiment.

First, an example of an overall configuration of the high-frequency circuit module of the exemplary embodiment will be explained with reference to FIG. 1. FIG. 1 is an oblique view of the high-frequency circuit module. As illustrated in FIG. 1, the high-frequency circuit module of the exemplary embodiment mainly includes a signal converter 100 and a semiconductor circuit chip 200. The signal converter 100 includes a dielectric substrate 102, a first conductor layer 120, a second conductor layer 130 and a plurality of conducting members 140. The signal converter 100 is supported by a support member 150.

The second conductor layer 130 is disposed entirely on one of opposite sides of the dielectric substrate 102, while the first conductor layer 120 is disposed on the other of the opposite sides of the dielectric substrate 102.

The conducting members 140 penetrate the dielectric substrate 102 for electrically connecting the first conductor layer 120 and the second conductor layer 130. As illustrated in FIG. 1, a plurality of the conducting members 140 is prepared. Some of the conducing members 140, arranged within an area depicted with a dashed-dotted line A (hereinafter referred to as "an area A"), will be hereinafter referred to as first conducting members 142. The first conductor layer 120, the second conductor layer 130 and a plurality of the first conducting members 142 form a waveguide within the area A in the inside of the dielectric substrate 102.

The first conducting members 142 inhibit leakage of high-frequency signals propagating the waveguide in a direction perpendicular to a propagation direction of high-frequency signals. Therefore, the number of the first conducting members 142 and pitches for arranging the first conducting members 142 are not particularly limited as long as the first conducting members 142 inhibits leakage of high-frequency signals propagating the waveguide.

High-frequency signals, inputted from the semiconductor circuit chip 200, propagate the waveguide formed in the signal converter 100 and further propagate a hollow waveguide tube (not illustrated in the figure) disposed ahead of the waveguide. The high-frequency signals are subsequently transmitted from an antenna connected to the hollow waveguide tube.

Figure 2:
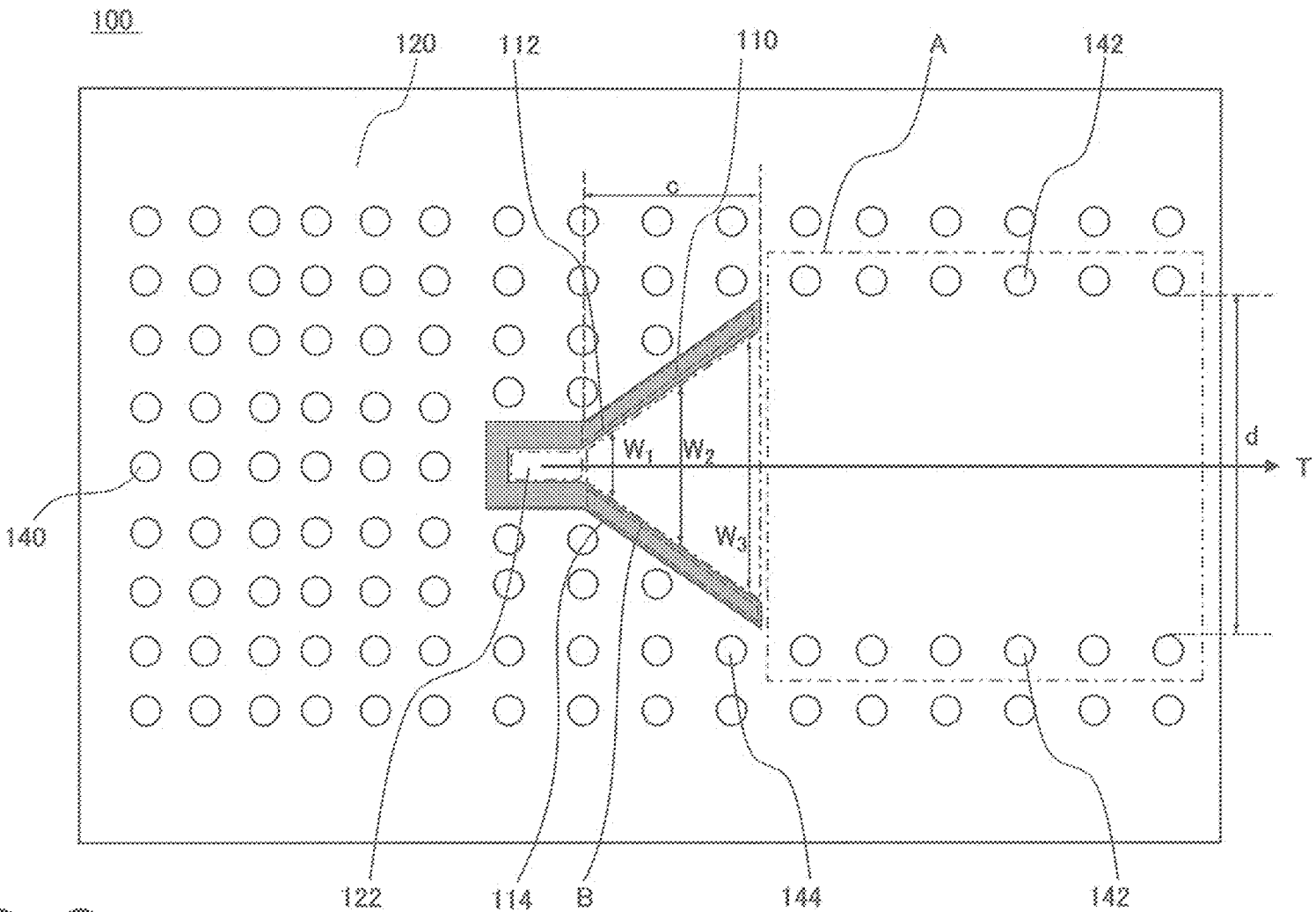
FIG. 2 is a plan view of a signal converter seen from a side of the signal converter that a first conductor layer is formed.

Next, the shape of the first conductor layer 120 disposed in the signal converter 100 of the present exemplary embodiment will be hereinafter explained with reference to FIG. 2. FIG. 2 is a plan view of the signal converter 100 seen from a side of the signal converter 100 that the first conductor layer 120 is disposed. As illustrated in FIG. 2, the conductor layer 120 is disposed on the dielectric layer 102 in the signal converter 100 excluding a separator section 110. The first conductor layer 120 includes an input section 122 configured to receive high-frequency signals inputted from the semiconductor circuit chip 200. High-frequency signals, inputted into the input section 122, propagate towards the area A that the waveguide is formed along a direction depicted with an arrow T. The direction T, a direction that high-frequency signals inputted into the input section 122 propagate, will be hereinafter refereed to as "a propagation direction".

The separator section 110 includes a first section 112 and a second section 114. The first and second sections 112, 114 are separated in opposite directions perpendicular to a hypothetical axis extended along the propagation direction T of high-frequency signals propagating from the input section 122 to the waveguide (i.e., the area A). The interval between the first section 112 and the second section 114 is gradually increased in proportion to distance away from the input section 122 towards the waveguide (i.e., the area A).

In the example illustrated in FIG. 2, the separator section 110 is formed for linearly separating the first section 112 and the second section 114 and increasing their interval in proportion to distance away from the input section 122 towards the waveguide (i.e., the area A). However, the separator section 110 may not be formed as described above. For example, the separator section 110 may be formed for curvedly separating the first section 112 and the second section 114 and increasing their interval in proportion to distance away from the input section 122 towards the waveguide (i.e., the area A). Further, the first and second sections 112, 114 of the separator section 110 may not be positioned exactly symmetric to each other through the hypothetical axis extended along the propagation direction T of high-frequency signals propagating from the input section 122 to the waveguide.

Figure 3:
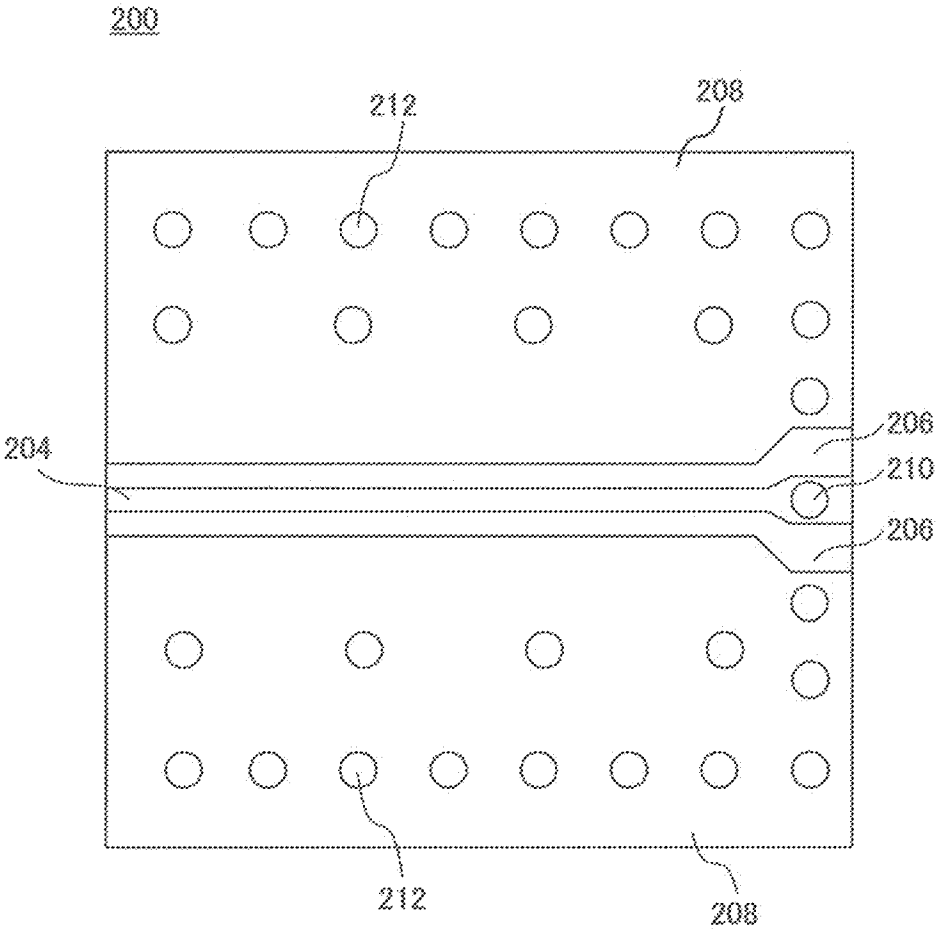
FIG. 3 is a plan view of a semiconductor circuit chip.

Next, the semiconductor circuit chip 200, mounted on the signal converter 100 of the present exemplary embodiment, will be explained with reference to FIG. 3. FIG. 3 is a plan view of the semiconductor circuit chip 200 seen from a side of the semiconductor circuit chip 200 faced to and mounted on the signal converter 100. As illustrated in FIG. 3, the semiconductor circuit chip 200 includes a semiconductor circuit substrate 202 to be described, a signal line 204, a ground layer 208 and a plurality of metal bumps 210, 212. The signal line 204 and the ground layer 208 are disposed on the semiconductor circuit substrate 202. The ground layer 208 is a metal layer for providing a ground potential. The signal line 204 and the ground layer 208 are separated through gaps 206.

The metal bump 210, disposed on the signal line 204, is electrically connected to the input section 122 explained with reference to FIG. 2. On the other hand, the metal bumps 212, disposed on the ground layer 208, are electrically connected to the first conductor layer 120.

Figure 4:
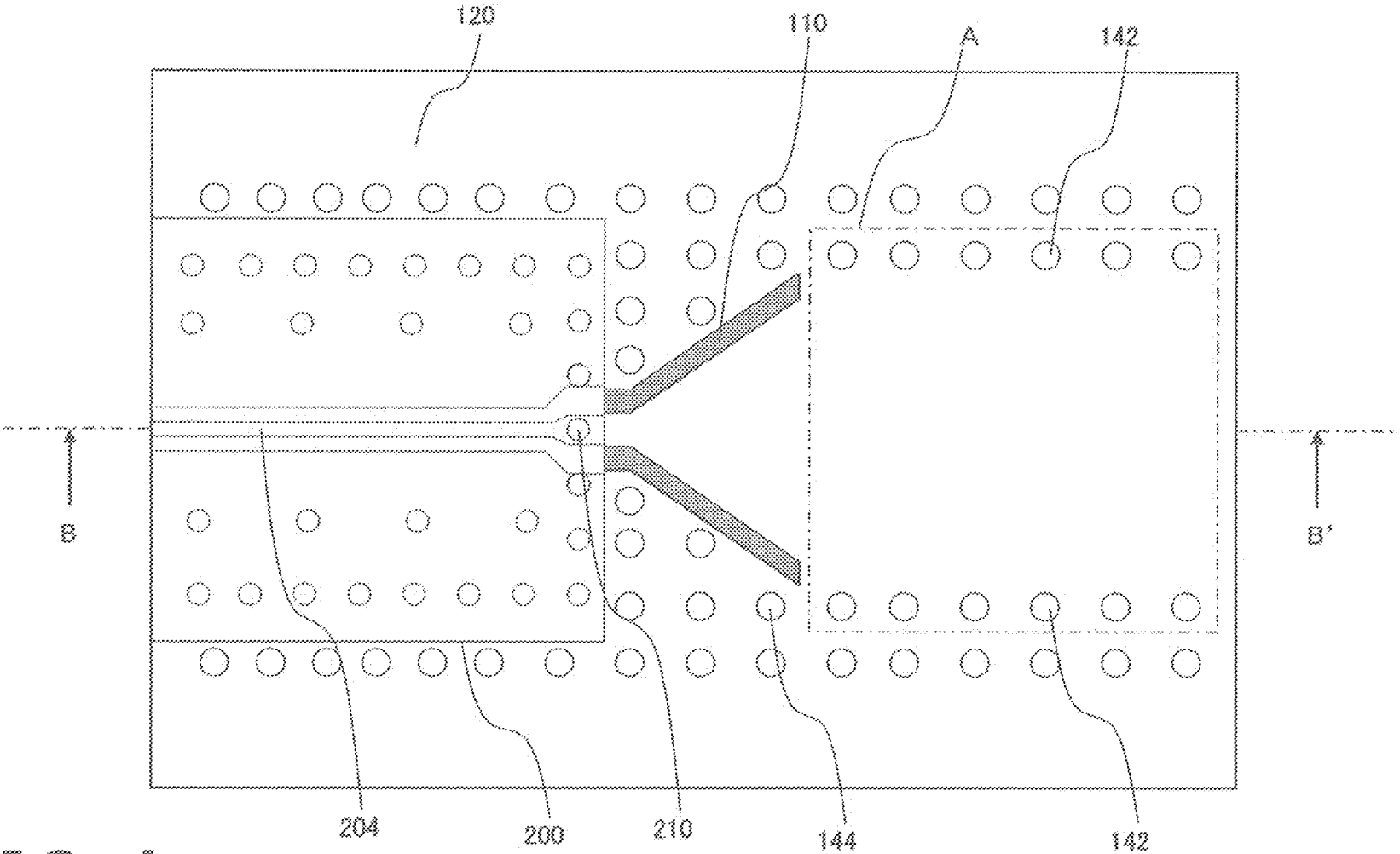
FIG. 4 is a plan view of the high-frequency circuit module.

Next, the high-frequency circuit module, formed by mounting the semiconductor circuit chip 200 on the signal converter 100 of the present exemplary embodiment, will be hereinafter explained with reference to FIG. 4. FIG. 4 is a plan view of the high-frequency circuit module. High-frequency signals are inputted from the signal line 204 of the semiconductor circuit chip 200 to the input section 122 of the signal converter 100 through the metal bump 210 of the semiconductor circuit chip 200. For achieving this, the semiconductor circuit chip 200 is mounted on the signal converter 100 under the condition that the metal bump 210 is positioned on the input section 122 as explained with reference to FIG. 2.

Figure 5:
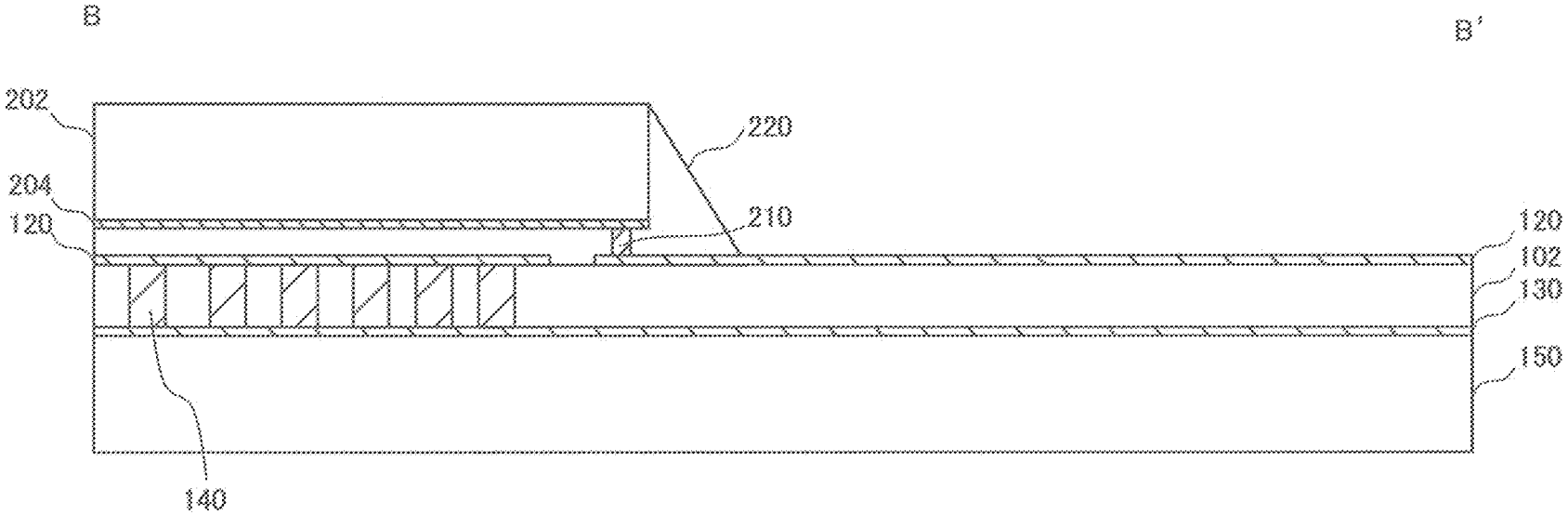
FIG. 5 is a cross-sectional view of the high-frequency circuit module sectioned along a line B-B' in FIG. 3.

Next, a cross-sectional shape of the high-frequency circuit module of the present exemplary embodiment will be explained with reference to FIG. 5. FIG. 5 is a cross-sectional view of the high-frequency circuit module sectioned along a line B-B' in FIG. 4. As illustrated in FIG. 5, an underfiller 220 is filled between the signal converter 100 and the semiconductor circuit chip 200. The underfiller 220 stabilizes an electrical connection between the signal converter 100 and the semiconductor circuit chip 200 through the metal bumps 210, 212. Thus, the semiconductor circuit chip 200 is mounted on the signal converter 100 by means of flip-chip bonding.

Further, the conducting members 140 penetrate the dielectric substrate 102 for electrically connecting the first conductor layer 120 and the second conductor layer 130 as illustrated in FIG. 5. FIG. 5 illustrates only some of the conducting members 140 aligned along the line B-B' in FIG. 4. However, the rest of the conducting members 140 (including 142 and 144) similarly penetrate the dielectric substrate 102 for electrically connecting the first conductor layer 120 and the second conductor layer 130.

Further, FIG. 5 illustrates only the metal bump 210, which is disposed on the signal line 204 while being aligned along the line B-B' in FIG. 4. However, other metal bumps 212 are similarly connected to the first conductor layer 120.

Next, a series of actions will be hereinafter explained with reference to FIGS. 2 and 5 regarding conversion of signals inputted from the semiconductor circuit chip 200 from the normal mode to the propagation mode for propagating the waveguide formed in the inside of the dielectric substrate 102 within the area A.

High-frequency signals, propagating the signal line 204 of the semiconductor circuit chip 200, is inputted into the input section 122 of the first conductor layer 120 through the metal bump 210. High-frequency signals, inputted into the input section 122, propagate an area of the first conductor layer 120 disposed transversely (i.e., vertically in FIG. 2) inwards of the separator section 110 (i.e., an area of the first conductor layer 120 interposed between the first section 112 and the second section 114) along the propagation direction T.

As described above, the first and second sections 112, 114 of the separator section 110 are separated in opposite directions perpendicular to the hypothetical axis extended along the propagation direction T of high-frequency signals propagating from the input section 122 to the waveguide (i.e., the area A). Further, the interval between the first section 112 and the second section 114 is gradually increased in proportion to distance away from the input section 122 towards the waveguide (i.e., the area A). The area of the first conductor layer 120, disposed transversely inwards of the separator section 110 (i.e., interposed between the first section 112 and the second section 114), has a width (i.e., length in a direction perpendicular to the propagation direction T) gradually increased towards the waveguide along the propagation direction T. The area of the first conductor layer 120 depicted with a dashed-dotted line B, disposed transversely inwards of the separator section 110 (i.e., interposed between the first section 112 and the second section 114), will be hereinafter referred to as "a signal conversion area" for convenience of explanation.

High-frequency signals, propagating the signal conversion area, are herein electromagnetically coupled through the separator section 110 to areas of the first conductor layer 120 disposed outwards of the separator section 110 with respect to the hypothetical axis extended along the propagation direction T of high-frequency signals. Simultaneously, high-frequency signals, propagating the signal conversion area, are electromagnetically coupled to the second conductor layer 130 through the dielectric substrate 102. Electromagnetic coupling primarily occurs between a transversely-narrow portion of the signal conversion area (e.g., a portion of the signal conversion area represented with a double-headed arrow $W_1$ in FIG. 2) and the areas of the first conductor layer 120 disposed transversely outwards of the separator section 110. However, electromagnetic coupling increasingly occurs between the second conductor layer 130 and a transversely-wide portion of the signal conversion area (e.g., a portion of the signal conversion area represented with a double-headed arrow $W_2$ in FIG. 2). Further, electromagnetic coupling primarily occurs between the second conductor layer 130 and a transversely-widest portion of the signal conversion area (i.e., a portion of the signal conversion area represented with a double-headed arrow $W_3$ in FIG. 2). High-frequency signals, inputted from the semiconductor circuit chip 200, are thus gradually converted from the normal mode to the waveguide propagation mode in the signal conversion area towards the waveguide along the propagation direction T.

As illustrated as the area A, the waveguide is disposed on the downstream of the signal conversion area in the propagation direction T. High-frequency signals propagate the waveguide after being converted from the normal mode to the propagation mode in the signal conversion area.

As explained above, the signal converter 100 of the present exemplary embodiment has the following structure. Simply put, the first and second sections 112, 114 are extended from the input section 122 towards the waveguide. Further, the first conductor layer 120 is disposed on the dielectric substrate 102 without occupying the separator section 110 disposed on the dielectric substrate 102. The first and second sections 112, 114, forming the separator section 110, are separated in opposite directions perpendicular to the hypothetical axis extended from the input section 122 to the waveguide (i.e., the area A) along the propagation direction T of high-frequency signals for gradually increasing the interval between the first section 112 and the second section 114 in proportion to distance away from the input section 122 towards the waveguide. Unlike the signal converters of the well-known types, the signal converter of the present exemplary embodiment does not include a conducting section for converting, from the normal mode to the propagation mode, high-frequency signals inputted from the semiconductor circuit chip 200. The signal converter of the present exemplary embodiment does not thereby cause manufacturing trouble regarding positional displacement between the separator section 110 and the conducting section for converting high-frequency signals from the normal mode to the propagation mode, unlike the signal converters of the well-known types. It is consequently possible for the signal converter of the present exemplary embodiment to efficiently convert high-frequency signals from the normal mode to the waveguide propagation mode.

<Second Exemplary Embodiment>

Next, a signal converter and a high-frequency circuit module of a second exemplary embodiment will be hereinafter explained. The basic configurations of the signal converter and the high-frequency circuit module of the present exemplary embodiment are the same as those of the first exemplary embodiment. Therefore, different points from the first exemplary embodiment will be hereinafter explained.

Figure 6:
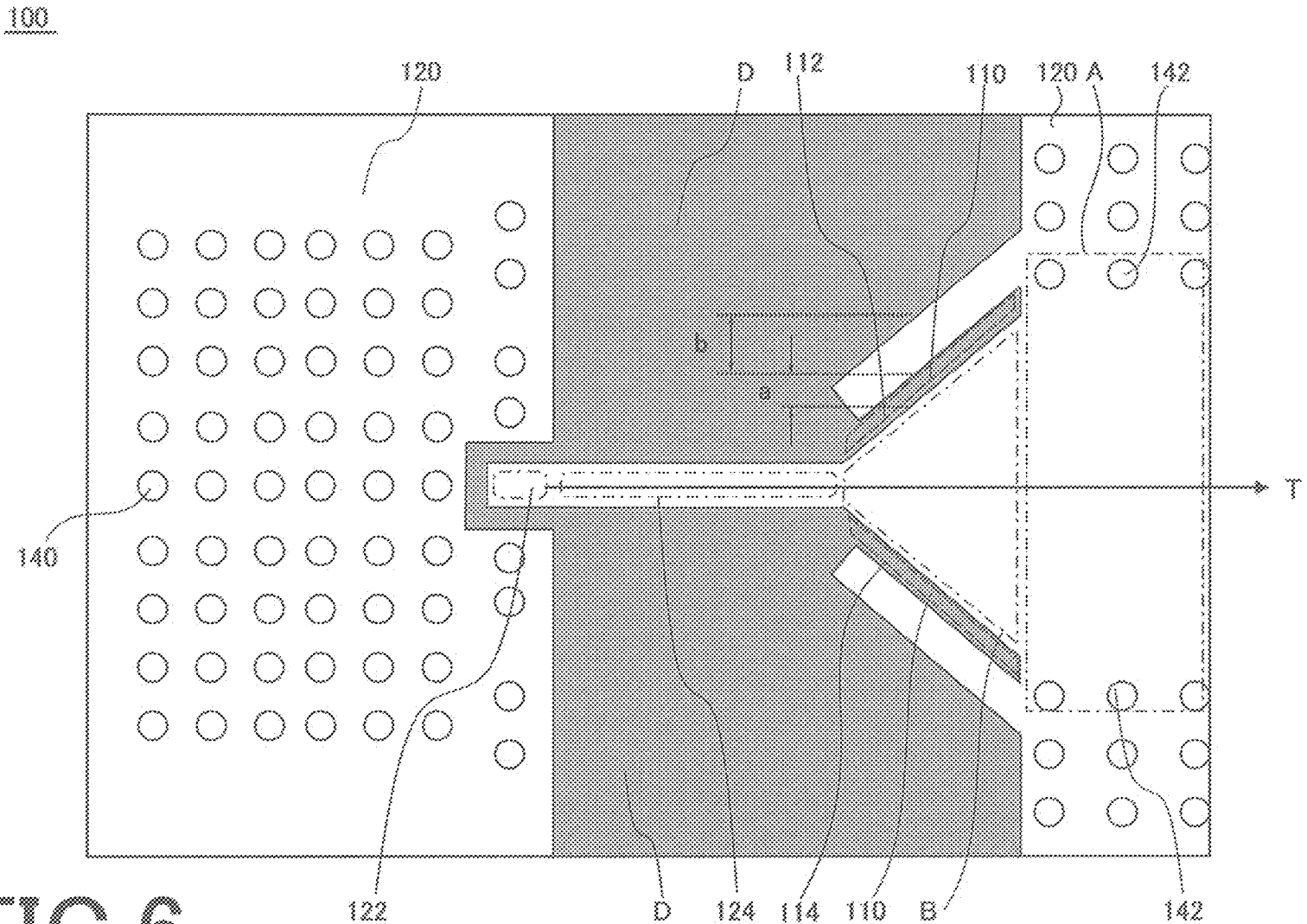
FIG. 6 is a plan view of a signal converter according to a second exemplary embodiment seen from a side of the signal converter that a first conductor layer is formed.

In the present exemplary embodiment, the shape of the first conductor layer 120 formed in the signal converter 100 is different from that of the first exemplary embodiment. The shape of the first conductor layer 120 formed in the signal converter 100 of the present exemplary embodiment will be explained with reference to FIG. 6. FIG. 6 is a plan view of the signal converter 100 seen from the side thereof that the first conductor layer 120 is disposed. As illustrated in FIG. 6, the first conductor layer 120 is disposed on an area of the dielectric substrate 102 excluding a non-conductive area (i.e., an area depicted with a hatched pattern D in FIG. 6). Simply put, the dielectric substrate 102 is exposed through the non-conductive area D illustrated in FIG. 6. The non-conductive area D includes the separator section 110. Further, the separator section 110 includes the first section 112 and the second section 114. The first conductor layer 120 includes a microstrip line 124 for transmitting high-frequency signals inputted into the input section 122. High-frequency signals, inputted into the input section 122 from the semiconductor circuit chip 200, propagate through the microstrip line 124 and a signal conversion area (i.e., an area depicted with a dashed-dotted line B in FIG. 6) along a propagation direction depicted with an arrow T in FIG. 6.

In the present exemplary embodiment, the width of the separator section 110 (i.e., length of the first/second section 112/114 in a direction perpendicular to the propagation direction T as represented with two faced arrows a in FIG. 6) is less than the width of the respective areas of the first conductor layer 120 disposed transversely (i.e., vertically in FIG. 6) outwards of the separator section 110 (i.e., length represented with a double-headed arrow b in FIG. 6).

Next, a series of actions will be explained with reference to FIG. 6 regarding conversion of signals inputted from the semiconductor circuit chip 200 from the normal mode to the propagation mode for propagating the waveguide formed in the inside of the dielectric substrate 102 within the area A.

High-frequency signals, propagating the signal line 204 of the semiconductor circuit chip 200, are inputted into the input section 122 of the first conductor layer 120 through the metal bump 210. The high-frequency signals, inputted into the input section 122, propagate an area of the first conductor layer 120 (i.e., a signal conversion area), disposed transversely inwards of the separator section 110 (i.e., interposed between the first section 112 and the second section 114) through the microstrip line 124 along the propagation direction T. Similarly to the first exemplary embodiment, the high-frequency signals inputted from the semiconductor circuit chip 200 are gradually converted from the normal mode to the waveguide propagation mode in the signal conversion area towards the waveguide along the propagation direction T. In the present exemplary embodiment, the width (i.e., length in a direction perpendicular to the propagation direction T) of the separator section 110 is herein less than the width of the respective areas of the first conductor layer 120 disposed outwards of the separator section 110 with respect to the propagation direction T of high-frequency signals. The areas of the first conductor layer 120, disposed transversely outwards of the separator section 110, herein inhibit high-frequency signals from leaking out of the separator section 110 during propagation through the signal conversion area.

As illustrated as the area A, the waveguide is disposed on the downstream of the signal conversion area in the propagation direction T. High-frequency signals propagate the waveguide after being converted from the normal mode to the propagation mode in the signal conversion area.

As described above, the signal converter of the present exemplary embodiment has the following structure. Simply put, the first conductor layer 120 is disposed on the dielectric substrate 102 under the condition that the width (i.e., length in a direction perpendicular to the propagation direction T) of the separator section 110 is less than the width of the respective areas of the first conductor layer 120 disposed outwards of the separator section 110 with respect to the hypothetical axis extended along the propagation direction T. It is therefore possible for the signal converter 100 of the present exemplary embodiment to inhibit leakage of high-frequency signals out of the separator section 110 during propagation through the signal conversion area. It is consequently possible for the signal converter 100 of the present exemplary embodiment to efficiently convert high-frequency signals from the normal mode to the waveguide propagation mode.

<Third Exemplary Embodiment>

Next, a signal converter and a high-frequency circuit module according to a third exemplary embodiment will be explained. The basic configurations of the signal converter and the high-frequency circuit module of the present exemplary embodiment are the same as those of the second exemplary embodiment. Therefore, different points from the second exemplary embodiment will be hereinafter explained.

Figure 7:
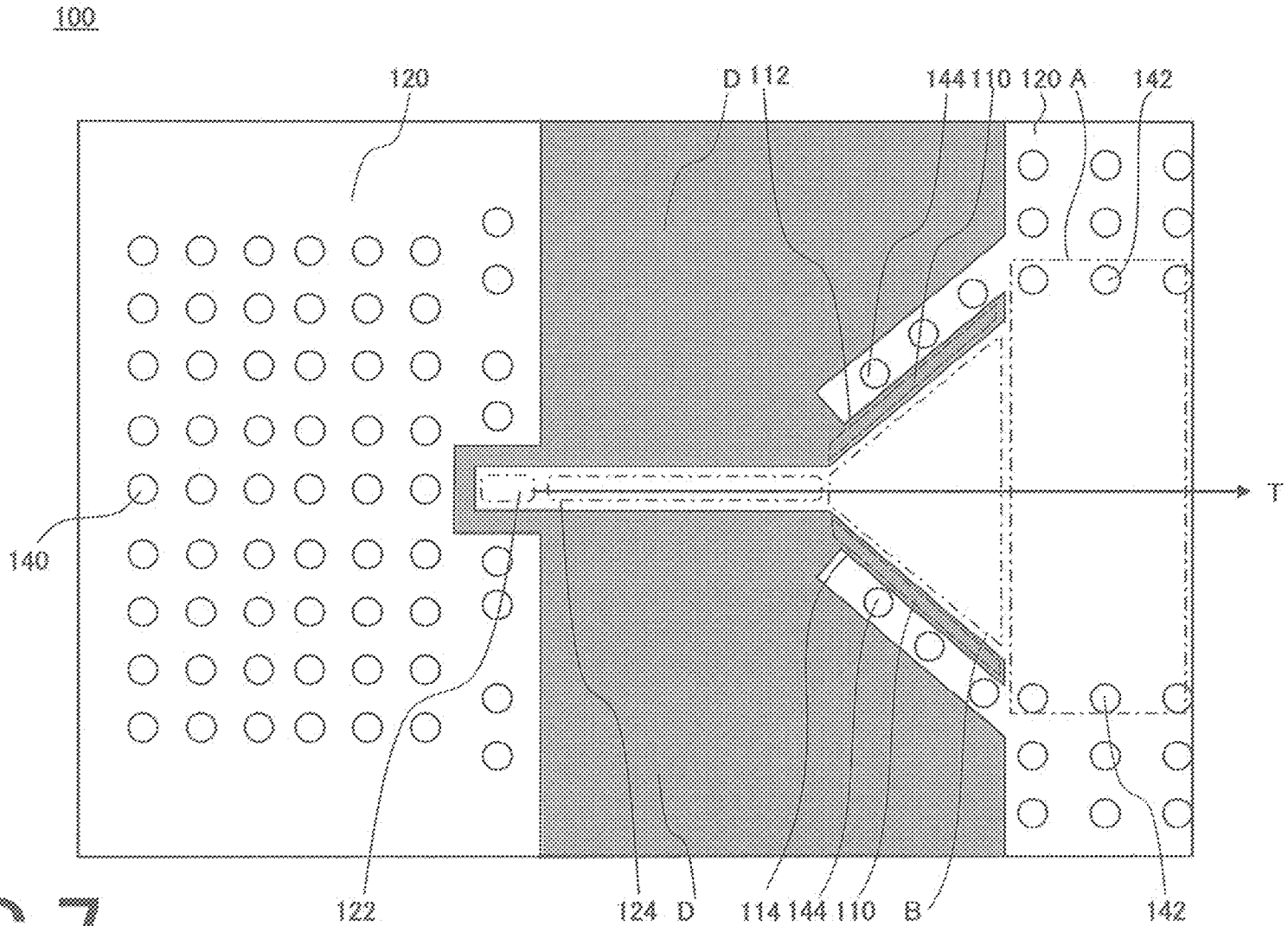
FIG. 7 is a plan view of a signal converter according to a third exemplary embodiment seen from a side of the signal converter that a first conductor layer is formed.
Figure 8A:
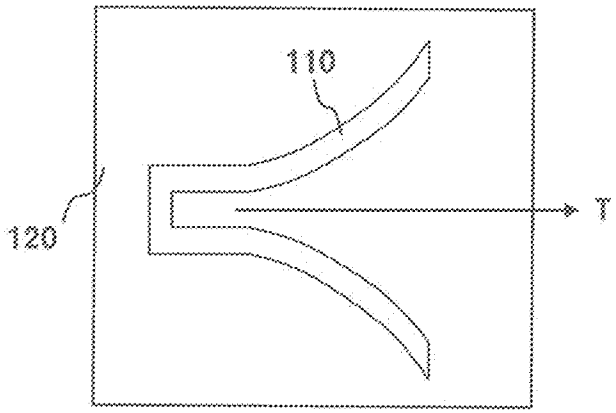
FIG. 8A is a plan view of a signal converter according to a second modification seen from a side of the signal converter that a first conductor layer is formed.
Figure 8B:
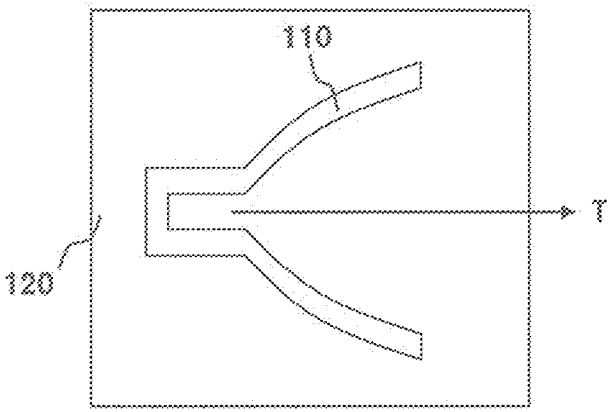
FIG. 8B is a plan view of a signal converter according to a second modification seen from a side of the signal converter that a first conductor layer is formed.
Figure 8C:
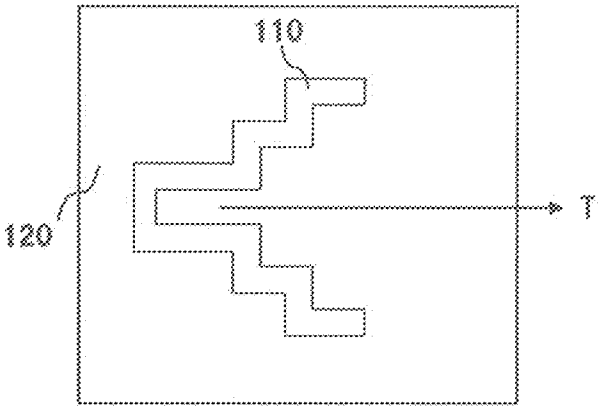
FIG. 8C is a plan view of a signal converter according to a second modification seen from a side of the signal converter that a first conductor layer is formed.
Figure 8D:
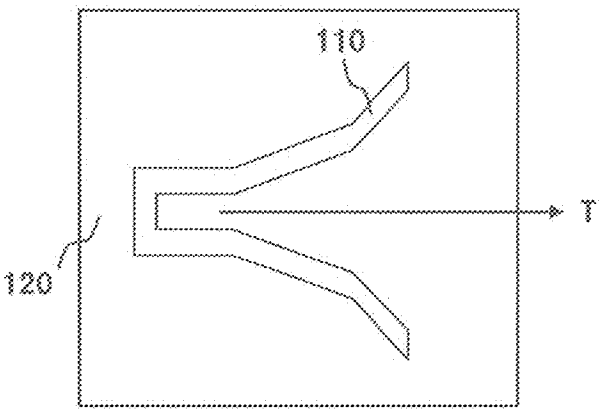
FIG. 8D is a plan view of a signal converter according to a second modification seen from a side of the signal converter that a first conductor layer is formed.

The signal converter 100 of the present exemplary embodiment will be explained with reference to FIG. 7. FIG. 7 is a plan view of the signal converter 100 seen from the side thereof that the first conductor layer 120 is disposed. In the present exemplary embodiment, the shape of the first conductor layer 120 formed in the signal converter 100 is the same as that of the second exemplary embodiment. In the present exemplary embodiment, conducting sections 144 are disposed on areas of the first conductor layer 120 disposed outwards of the separator section 110 with respect to the hypothetical axis extended along the propagation direction T of high-frequency signals, as illustrated in FIG. 7. The conducting sections 144 penetrate the dielectric substrate 102 for electrically connecting the second conductor layer 130 and the areas of the first conductor layer 120 disposed transversely (i.e., vertically in FIG. 7) outwards of the separator section 110. The conducting sections 144, penetrating the dielectric substrate 102 for electrically connecting the second conductor layer 130 and the areas of the first conductor layer 120 disposed transversely outwards of the separator section 110, will be hereinafter referred to as second conducting sections 144.

The second conducting sections 144 inhibit high-frequency signals from leaking out of the separator section 110 during propagation through the signal conversion area (i.e., an area depicted with a dashed-dotted line B in FIG. 7).

In the present exemplary embodiment, a series of actions are the same as those of the second exemplary embodiment regarding conversion of signals inputted from the semiconductor circuit chip 200 from the normal mode to the propagation mode for propagating the waveguide formed in the inside of the dielectric substrate 102 within the area A. Therefore, explanation thereof will be hereinafter omitted.

As described above, the signal converter 100 of the present exemplary embodiment includes the second conducting sections 144 penetrating the dielectric substrate 102 for electrically connecting the second conductor layer 130 and the areas of the first conductor layer 120 disposed outwards of the separator section 110 with respect to the hypothetical axis extended along the propagation direction T. It is thereby possible for the signal converter of the present exemplary embodiment to inhibit leakage of high-frequency signals out of the separator section 110 during propagation through the signal conversion area. It is consequently possible for the signal converter 100 of the present exemplary embodiment to efficiently convert high-frequency signals from the normal mode to the waveguide propagation mode.

The signal converter 100, explained as an example of the first exemplary embodiment with reference to FIG. 2, also includes the second conducting sections 144 penetrating the dielectric substrate 102 for electrically connecting the second conductor layer 130 and the areas of the first conductor layer 120 disposed outwards of the separator section 110 with respect to the hypothetical axis extended along the propagation direction T. Therefore, it is also possible for the signal converter of the type illustrated in FIG. 2 to inhibit leakage of high-frequency signals out of the separator section 110 during propagation through the signal conversion area.

(First Modification)

Next, a signal converter and a high-frequency circuit module of a first modification will be hereinafter explained. The present modification will be explained with reference to FIG. 2 exemplified as the first exemplary embodiment. However, the present modification may be applied to the aforementioned exemplary embodiments.

Wavelengths of high-frequency signals inputted into the input section 122 from the semiconductor circuit chip 200 are herein assumed to be λ. In the signal converter 100 of the present modification, the first conductor layer 120 is disposed on the dielectric substrate 102 for setting a length represented with a double-headed arrow c in FIG. 2 to be greater than or equal to λ/4 and simultaneously less than or equal to 3λ/4. The length represented with the double-headed arrow c is herein obtained by orthographically projecting the separator section 110 onto the hypothetical axis extended from the input section 122 towards the waveguide (i.e., the area A) along the propagation direction T of high-frequency signals.

It is possible to reduce reflection of high-frequency signals to be transmitted to the waveguide (i.e., the area A) by setting the length represented with the double-headed arrow c in FIG. 2 to be greater than or equal to λ/4. Further, the length represented with the double-headed arrow c in FIG. 2 is preferably set to be less than or equal to 3λ/4 for compactly forming the signal converter 100.

As explained above, in the signal converter of the present modification, the first conductor layer 120 is disposed on the dielectric substrate 102 under the condition that the length, obtained by orthographically projecting the separator section 110 onto the hypothetical axis extended from the input section 122 to the waveguide (i.e., the area A) along the propagation direction T of high-frequency signals, is set to be greater than or equal to λ/4 and simultaneously less than or equal to 3λ/4. It is thereby possible for the signal converter 100 of the present modification to reduce reflection of high-frequency signals to be transmitted to the waveguide. It is consequently possible for the signal converter 100 of the present modification to efficiently convert high-frequency signals from the normal mode to the waveguide propagation mode.

(Second Modification)

Next, a signal converter and a high-frequency circuit module according to a second modification will be explained with reference to FIGS. 8A, 8B, 8C and 8D. FIGS. 8A, 8B, 8C and 8D are plan views of the signal converter 100 of the present modification, seen from the side thereof that the first conductor layer 120 is formed. In the present modification, the shape of the first conductor layer 120 formed in the signal converter 100 is different from that of the first conductor layer 120 illustrated in FIG. 2.

As described above, the first and second sections 112, 114 of the separator section 110 are separated in opposite directions perpendicular to the hypothetical axis extended along the propagation direction T of high-frequency signals propagating from the input section to the waveguide (i.e., the area A). Further, the interval between the first section 112 and the second section 114 is gradually increased in proportion to distance away from the input section 122 towards the waveguide (i.e., the area A). Therefore, the shape of the separator section 110 is not limited to that of the separator section 110 illustrated in FIG. 2 as long as the first and second sections 112, 114 are formed to be gradually separated from each other along the propagation direction T. For example, an exemplary separator section 110, illustrated in FIG. 8A, has a shape that the first section 112 and the second section 114 are curvedly separated for increasing their interval in proportion to distance away from the input section 122 along the propagation direction T. The center of curvature in each curved portion is positioned transversely (i.e., vertically in FIG. 8A) outwards of the separator section 110. Next, an exemplary separator section 110 illustrated in FIG. 8B also has a shape that the first section 112 and the second section 114 are curvedly separated and their interval is increased in proportion to distance away from the input section 122 along the propagation direction T. However, the center of curvature in each curved portion is positioned transversely (i.e., vertically in FIG. 8B) inwards of the separator section 110. Next, an exemplary separator section 110 illustrated in FIG. 8C has a shape that the first section 112 and the second section 114 are separated stepwise and their interval is increased in proportion to distance away from the input section 122 along the propagation direction T. Next, an exemplary separator section 110 illustrated in FIG. 8D has a shape that the first section 112 and the second section 114 are linearly separated and their interval is increased in proportion to distance away from the input section 122 along the propagation direction T. The first and second sections 112, 114 are herein bent outwards of the separator section 110.

Similarly to the aforementioned exemplary embodiments, it is possible for the present modification to efficiently convert high-frequency signals from the normal mode to the waveguide propagation mode.

(Third Modification)

Figure 9:
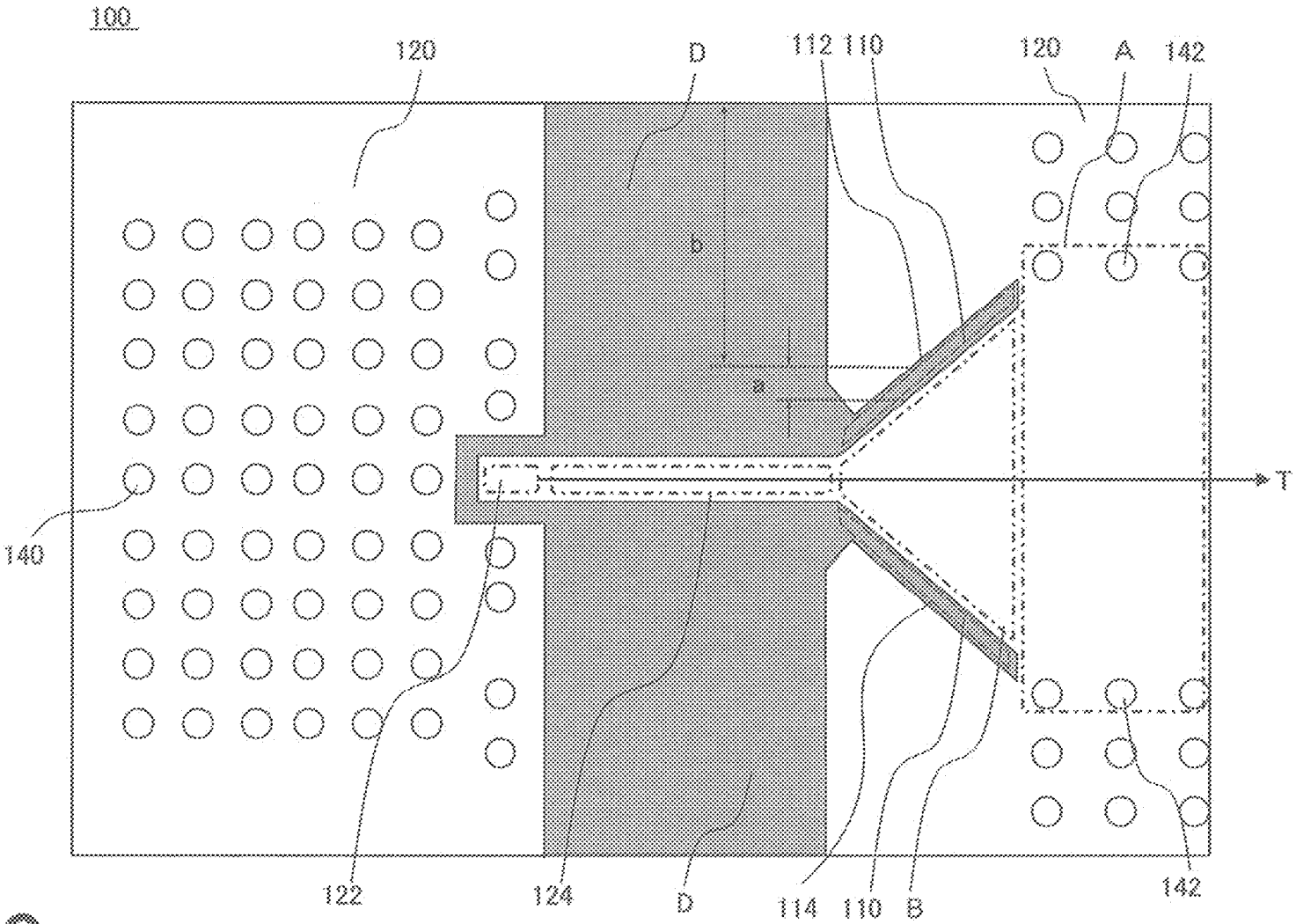
FIG. 9 is a plan view of a signal converter according to a third modification seen from a side of the signal converter that a first conductor layer is formed.

Next, a signal converter and a high-frequency circuit module according to a third modification will be explained with reference to FIG. 9. In the present modification, the shape of the first conductor layer 120 formed in the signal converter 100 is different from the shape of the first conductor layer 120 illustrated in FIG. 6 exemplified as the second exemplary embodiment. FIG. 9 is a plan view of the signal converter 100 of the third modification seen from the side thereof that the first conductor layer 120 is formed. As illustrated in FIG. 9, a conductor layer 120 is disposed on an area of the dielectric substrate 102 excluding a non-conductive area (i.e., an area depicted with a hatched pattern D in FIG. 9). In other words, the dielectric substrate 102 is exposed through the non-conductive area D illustrated in FIG. 9. The non-conductive area D includes the separator section 110. Further, the separator section 110 includes the first section 112 and the second section 114.

As described above, in the second exemplary embodiment, the width (i.e., length in a direction perpendicular to the propagation direction T) of the separator section 110 is less than the width of respective areas of the first conductor layer 120 disposed outwards of the separator section 110 with respect to the hypothetical axis extended along the propagation direction T of high-frequency signals. In the exemplary signal converter 100 illustrated in FIG. 9, the first conductor layer 120 is disposed on the dielectric substrate 102 under the condition that the width (i.e., length in a direction perpendicular to the propagation direction T) of the separator section 110 (i.e., length represented with two faced arrows a in FIG. 9) is less than the width of the respective areas of the first conductor layer 120 disposed outwards of the separator section 110 with respect to the hypothetical axis extended along the propagation direction T (i.e., length represented with a double-headed arrow b in FIG. 9). Similarly to the second exemplary embodiment, it is therefore possible for the signal converter 100 of the present modification to inhibit leakage of high-frequency signals out of the separator section 110 during propagation through the signal conversion area. It is consequently possible for the signal converter of the present modification to efficiently convert high-frequency signals from the normal mode to the waveguide propagation mode.

Further, in the present modification, it is preferable to form the second conducting sections 144 penetrating the dielectric substrate 102 for electrically connecting the second conductor layer 130 and the areas of the first conducive layer 120 disposed transversely (i.e., vertically in FIG. 9) outwards of the separator section 110.

(Fourth Modification)

Figure 10:
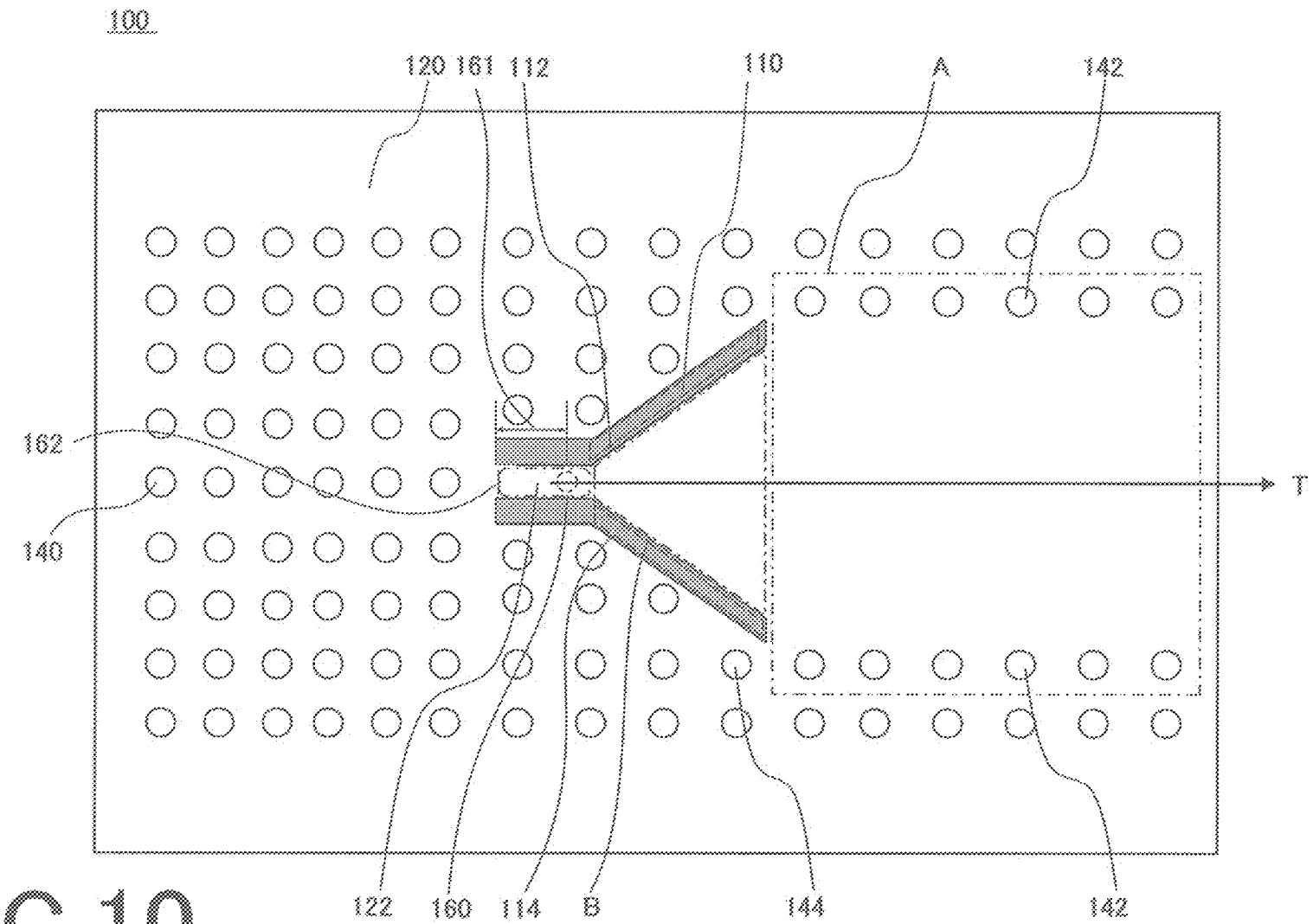
FIG. 10 is a plan view of a signal converter according to a fourth modification seen from a side of the signal converter that a first conductor layer is formed.

Next, a signal converter and a high-frequency circuit module according to a fourth modification will be explained with reference to FIG. 10. FIG. 10 is a plan view of the signal converter 100 of the fourth modification seen from the side thereof that the first conductor layer 120 is formed. The present modification is different from the aforementioned exemplary embodiments and the aforementioned modifications regarding the shape of the first conductor layer 120. In the aforementioned exemplary embodiments and the aforementioned modifications, the first conductor layer 120 is integrally formed with the separator section 110 as a single member. However, the shape of the first conductor layer 120 is not limited to the above.

For example, as illustrated in FIG. 10, the first conductor layer 120 may be formed as an individual member separate from the separator section 110. In this case, it is preferable to set a length 161 to be one-fourth of the wavelengths of high-frequency signals propagating the input section 122. The length 161 is a length from a terminal 160 (connected to another circuit) within the input section 122 to an end 162 disposed opposite to the signal conversion area (area depicted with a dashed-dotted line B in FIG. 10). High-frequency signals are short-circuited at the end 162, but are open-circuited at the terminal 160 separated away from the end 162 at a distance corresponding to one-fourth of the wavelengths of high-frequency signals. The line path having the length 161 is equivalent to be in a non-connected state. Therefore, signals from another circuit are transmitted to the signal conversion area through the terminal 160.

(Fifth Modification)

Next, a signal converter and a high-frequency circuit module of a fifth modification will be hereinafter explained. The present exemplary embodiment will be explained with reference to FIG. 2 exemplified as the first exemplary embodiment. However, the present modification may be applied to all of the aforementioned exemplary embodiments. The present modification inhibits occurrence of a higher-level propagation mode in the waveguide for enhancing a propagation efficiency of high-frequency signals.

A high-frequency signal is herein assumed to have a wavelength $\lambda_0$ in a vacuum state. Further, the dielectric substrate 102 is assumed to have a relative permittivity $\in_r$. In the signal converter of the present modification, the width of the waveguide (i.e., the area A), corresponding to a length represented with a double-headed arrow d in FIG. 2, satisfies the following formula (1):

$$d < \frac{\lambda_0}{2\sqrt{\varepsilon_r}} \tag{1}$$

The width of the waveguide is herein defined based on positions of two first conducting members 142 closest to the hypothetical axis extended from the input section 122 to the waveguide along the propagation direction T of high-frequency signals in plural first conducting members 142 disposed transversely (i.e., vertically in FIG. 2) outwards of the hypothetical axis.

According to the signal converter of the present modification, the width (i.e., length in a direction perpendicular to the propagation direction T) of the waveguide satisfies the aforementioned formula (1). Occurrence of a higher level propagation mode is therefore inhibited in the waveguide.

(Sixth Modification)

Figure 11:
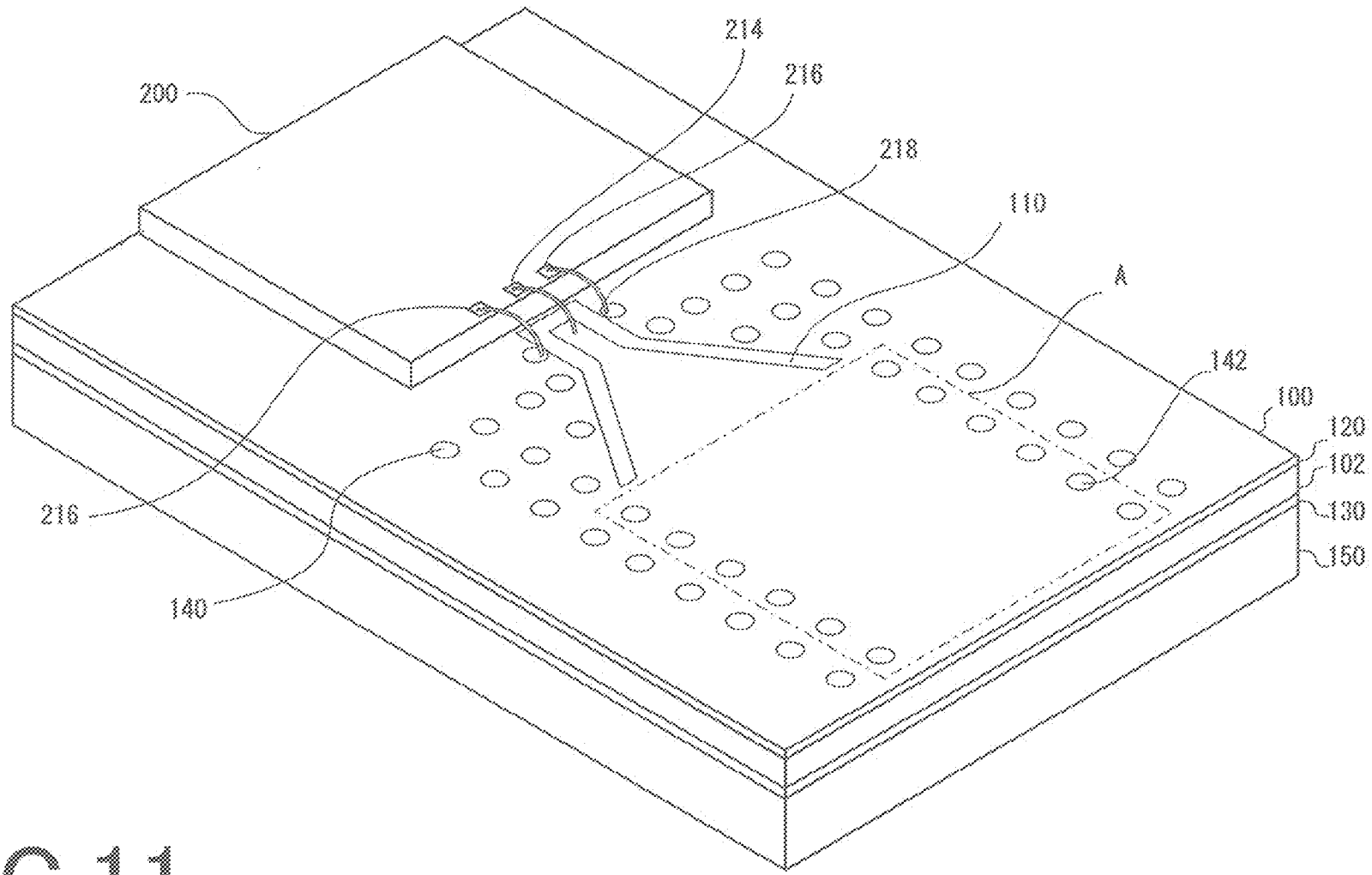
FIG. 11 is an oblique view of an overall configuration of a high-frequency circuit module according to a sixth modification.
Figure 12:
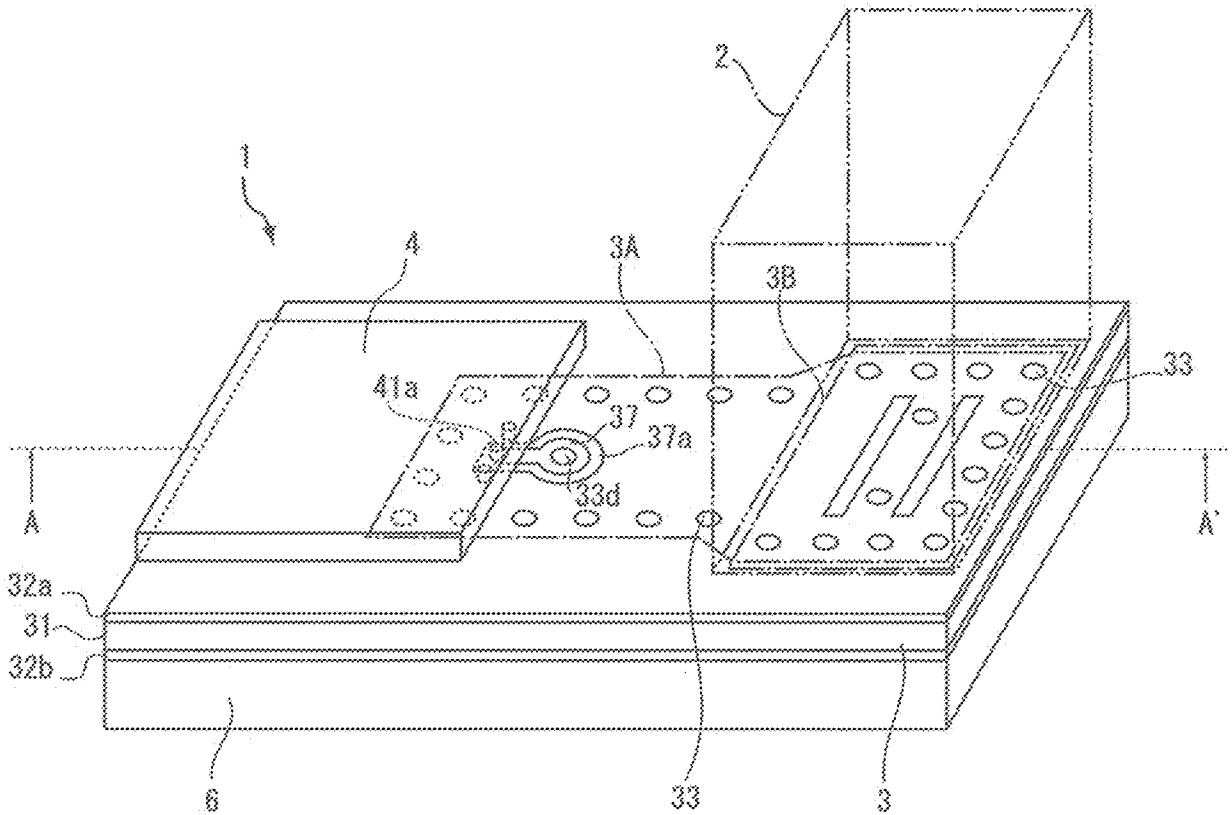
FIG. 12 is a schematic cross-sectional view of a high-frequency circuit module of a well-known type.
Figure 13:
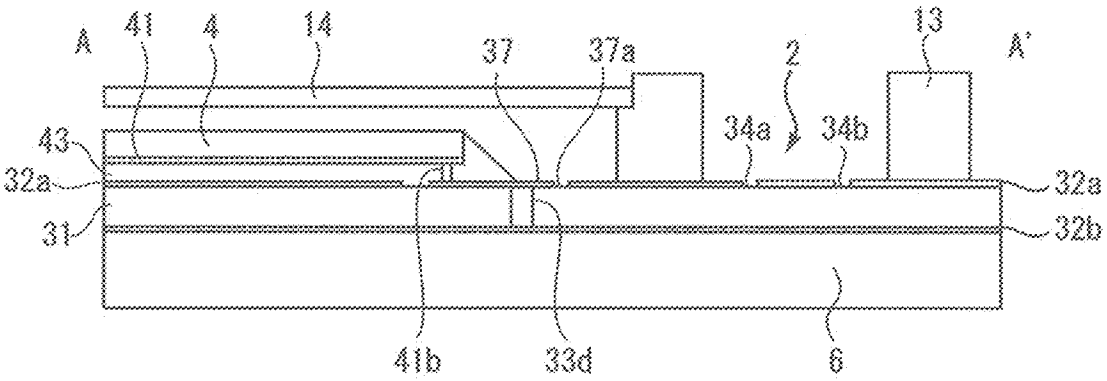
FIG. 13 is a cross-sectional view of the high-frequency circuit module sectioned along a line A-A' in FIG. 12.

Next, a high-frequency circuit module of a sixth modification will be explained with reference to FIG. 11. FIG. 11 is a perspective view of the high-frequency circuit module of the present modification. The present modification is different from the aforementioned exemplary embodiments and the aforementioned modifications regarding a method of mounting the semiconductor circuit chip 200 on the signal converter 100. In the high-frequency circuit modules explained in the aforementioned exemplary embodiments and the aforementioned modifications, the semiconductor circuit chip 200 is mounted on the signal converter 100 by flip-chip bonding. However, the method of mounting the semiconductor circuit chip 200 on the signal converter 100 is not limited to the above.

For example, as illustrated in FIG. 11, wire bonding may be adopted for mounting the semiconductor circuit chip 200 on the signal converter 100. The semiconductor circuit chip 200 of the present modification includes a signal terminal 214 and GND terminals 216. The semiconductor circuit chip 200 is disposed on the signal converter 100 under the condition that the side of the signal converter 100, including the signal terminal 214 and the GND terminals 216 thereon, is faced up. The signal terminal 214 is connected to the input section 122 of the signal converter 100 through a gold wire 218. On the other hand, the GND terminals 216 are respectively connected through the gold wires 218 to areas of the first conductor layer 120 disposed transversely outwards of the input section 122 through the separation section 110.

The aforementioned exemplary embodiments and the aforementioned modifications may be combined as needed. For example, similarly to the second exemplary embodiment, the first conductor layer 120 may be disposed on the dielectric substrate 102 under the condition that the width (i.e., length in a direction perpendicular to the propagation direction T) of the separator section 110 is less than the width of the areas of the first conductor layer 120 disposed outwards of the separator section 110 with respect to the hypothetical axis extended along the propagation direction T in FIG. 2 exemplified as the first exemplary embodiment.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present inventions have been described in detail, it should be understood that the various changes, substitutions, and alternations could be made hereto without departing from the spirit and scope of the invention.

What is claimed is:

1. A signal converter, comprising:

a dielectric substrate;

a first conductor layer disposed on one of opposite sides of the dielectric substrate, the first conductor layer including an input section, the input section configured to receive high-frequency signals inputted thereto;

a second conductor layer disposed on the other of the opposite sides of the dielectric substrate;

a plurality of first conducting sections penetrating the dielectric substrate for electrically connecting the first conductor layer and the second conductor layer, the first conducting sections forming a waveguide in the inside of the dielectric substrate together with the first conductor layer and the second conductor layer, wherein the first conductor layer is disposed on the dielectric substrate without occupying a separator section disposed on the dielectric substrate, the separator section including first and second sections extended from the input section towards the waveguide, the first and second sections separated from each other for gradually increasing an interval between the first and second sections in proportion to a distance away from the input section towards the waveguide.

2. The signal converter recited in one of claims 1, wherein a length obtained by orthographically projecting the separator section onto the hypothetical axis is greater than or equal to λ/4 and simultaneously less than or equal to 3λ/4, where wavelengths of the high-frequency signals are respectively set to be λ.

3. The signal converter recited in one of claims 1, wherein a width of the waveguide satisfies the following formula (1), where a width of the waveguide in a direction perpendicular to the propagation direction is set to be d and a permittivity of the dielectric substrate is set to be $\in_r$ $$d < \frac{\lambda_0}{2\sqrt{\varepsilon_r}} \quad (1)$$

4. A high-frequency circuit module, comprising;

the signal converter recited in one of claims 1; and a circuit chip configured to generate high-frequency signals, wherein the circuit chip includes: a signal line configured to transmit the high-frequency signals; and a metal bump disposed on the signal line, the metal bump electrically connected to the input section of the signal converter.

5. The signal converter recited in claim 1, wherein a width of the separator section in a direction perpendicular to a propagation direction of the high-frequency signals is less than a width of an area of the first conductor layer disposed outwards of the separator section with respect to a hypothetical axis extended from the input section towards the waveguide along the propagation direction of the high-frequency signals.

6. The signal converter recited in one of claims 5, wherein a length obtained by orthographically projecting the separator section onto the hypothetical axis is greater than or equal to λ/4 and simultaneously less than or equal to 3λ/4, where wavelengths of the high-frequency signals are respectively set to be λ.

7. The signal converter recited in one of claims 5, wherein a width of the waveguide satisfies the following formula (1), where a width of the waveguide in a direction perpendicular to the propagation direction is set to be d and a permittivity of the dielectric substrate is set to be $\in_r$ $$d < \frac{\lambda_0}{2\sqrt{\varepsilon_r}} \quad (1)$$

8. The signal converter recited in claim 5, further comprising:

a second conducting section penetrating the dielectric substrate for electrically connecting the area of the first conductor layer formed outwards of the separator section with respect to the hypothetical axis extended along the propagation direction of the high-frequency signals and an area of the second conductor layer formed outwards of the separator section with respect to the hypothetical axis extended along the propagation direction of the high-frequency signals.

9. The signal converter recited in one of claims 8, wherein a length obtained by orthographically projecting the separator section onto the hypothetical axis is greater than or equal to λ/4 and simultaneously less than or equal to 3λ/4, where wavelengths of the high-frequency signals are respectively set to be λ.

10. The signal converter recited in one of claims 8, wherein a width of the waveguide satisfies the following formula (1), where a width of the waveguide in a direction perpendicular to the propagation direction is set to be d and a permittivity of the dielectric substrate is set to be $\in_r$ $$d < \frac{\lambda_0}{2\sqrt{\varepsilon_r}} \quad (1)$$

* * * * *